US008598493B2

(12) United States Patent
Ohlsson et al.

(10) Patent No.: US 8,598,493 B2
(45) Date of Patent: Dec. 3, 2013

(54) HEATING SYSTEM

(75) Inventors: Lars Ohlsson, Ulricehamn (SE); Bo Nordqvist, Bollebygd (SE)

(73) Assignee: Swedesafe Marketing AB, Ulricehamn (SE)

( * ) Notice: Subject to any disclaimer, the term of this patent is extended or adjusted under 35 U.S.C. 154(b) by 1037 days.

(21) Appl. No.: 12/598,209

(22) PCT Filed: Apr. 29, 2008

(86) PCT No.: PCT/SE2008/050490

§ 371 (c)(1),
(2), (4) Date: Oct. 30, 2009

(87) PCT Pub. No.: WO2008/136743

PCT Pub. Date: Nov. 13, 2008

(65) Prior Publication Data

US 2010/0084390 A1 Apr. 8, 2010

(30) Foreign Application Priority Data

May 4, 2007 (SE) ..... 0701077

(51) Int. Cl.
*H05B 1/00* (2006.01)

(52) U.S. Cl.
USPC ..... 219/213

(58) Field of Classification Search
USPC ..... 219/213
See application file for complete search history.

(56) References Cited

U.S. PATENT DOCUMENTS 3,974,993 A * 8/1976 Hammecke ..... 246/428
4,391,425 A * 7/1983 Keep, Jr. ..... 246/428
6,147,308 A 11/2000 Santagata

FOREIGN PATENT DOCUMENTS

DE 4325002 A1 2/1995
JP 08105001 A 4/1996
JP 09025603 A 1/1997

OTHER PUBLICATIONS

Swedish Patent Office, Int'l Search Report in PCT/SE2008/050490, Jul. 2, 2008.
Swedish Patent Office, Int'l Preliminary Report on Patentability in PCT/SE2008/050490, Nov. 19, 2009.

* cited by examiner

*Primary Examiner* — Marc Armand
(74) *Attorney, Agent, or Firm* — Potomac Patent Group PLLC

(57) ABSTRACT

The invention relates to a heating system (190) for a switch (4) of a trackway (3) and comprising applicable electrically operating heater elements (2; 100; 103; 300). Said electrical heater elements (2; 100; 103) are arranged selectably connectable to a branch network (104) of electric connections extending along the switch (4) in question and intended for the connection of a desired number of heating plates (2) for the track railbase (23), friction-plate heaters (100) as well as supporting cleat heaters (103) to a relevant supply bar (110) for current extending along the length (L) of the switch.

13 Claims, 23 Drawing Sheets

HEATING SYSTEM

Figure 1:
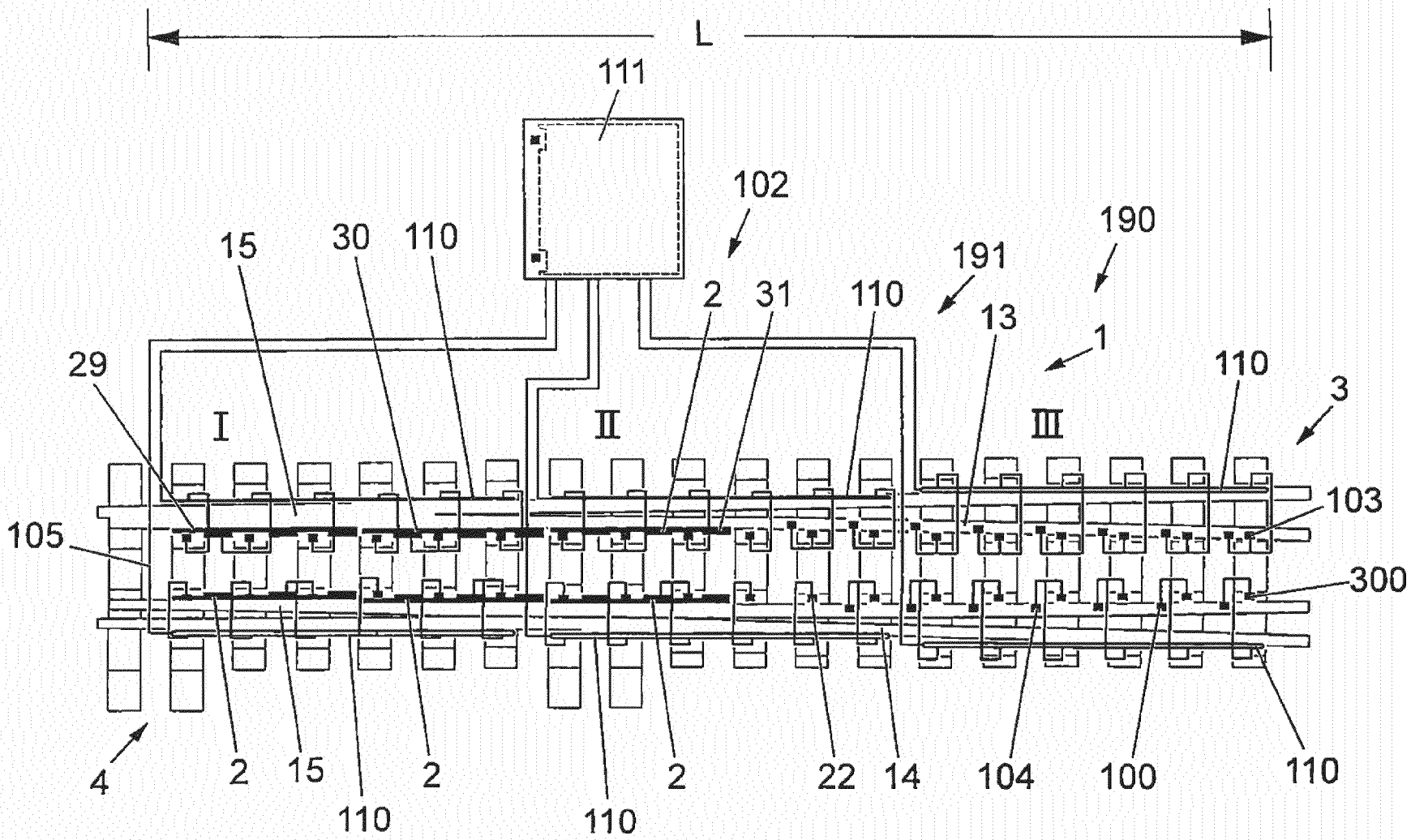

The present invention relates to a heating system for a switch of a trackway and comprising applicable electrically operating heating parts.

There are problems with the known switch heaters that today are used to keep switch points free from snow and ice. This means that the accessibility for the railway traffic decreases substantially when it is snowing, since the existing heaters do not manage to keep the gap formed between the existing switch blade, friction plates and supporting cleats of the switch and track rail free from snow and ice.

Known heaters are foremost in the form of a heater bar, denominated plate heating element, that is fitted to the base of the rail and that intends to heat the track rail to a temperature of between +10 and 12° C. A certain radiant heat is obtained and aims at keeping the surface between the blade and track rail free from ice. The element voltage of existing heaters is not within the extra-low voltage range. They are about 3 m long and can generate three different powers of 600 W, 900 W and 1200 W. Short circuit in today's heating system may occur and entails that signal systems and the like may be put out of gear. Also that, upon damage to the heaters, there is a risk of metal parts suddenly becoming live and highly dangerous because of the high voltage that, on that occasion, comes out into the same. The staff concerned experiences this as a great security risk and a problem. Today's system involving heating of switches has existed for 15-20 years. The system is very energy demanding and does not manage great amounts of snow. Said known system is used in principle around the world with a few exceptions.

The are also further switch heaters previously known, such as those that, for instance, are shown in U.S. Pat. No. 4,391,425 A; DE 4325002 A1; U.S. Pat. No. 4,656,333 A; as well as U.S. Pat. No. 5,004,190 A, and JP 2000038702; JP 8105001; JP 9025603; JP 2000058234; JP 7102501 as well as JP 9025603, respectively. Said known systems and heaters also function to heat the track rail and someone operates even with boiling water. Brushes and burners that remove snow and ice from switches are also found.

The main object of the present invention is therefore primarily to solve the problems that arise in such previously known switch heaters where the track rail and switch are heated and provide such a switch heater that functions to melt the snow already in connection with the same falling or encountering the area next to the switch between the track rail and the movable switch blade of the switch, as well as to provide a device that is simple and safe both in the construction and function.

In addition, an object of the invention is to facilitate a heating system that allows connection of heaters to desired parts in a switch as required.

Said object is attained by means of a heating system according to the present invention that essentially is characterized in that said electrical heater elements are arranged selectably connectable to a branch network of electric connections extending along the switch in question and intended for the connection of a desired number of heating plates for the track railbase, friction-plate heaters as well as supporting cleat heaters to a relevant supply bar for current extending along the length of the switch.

Figure 2:
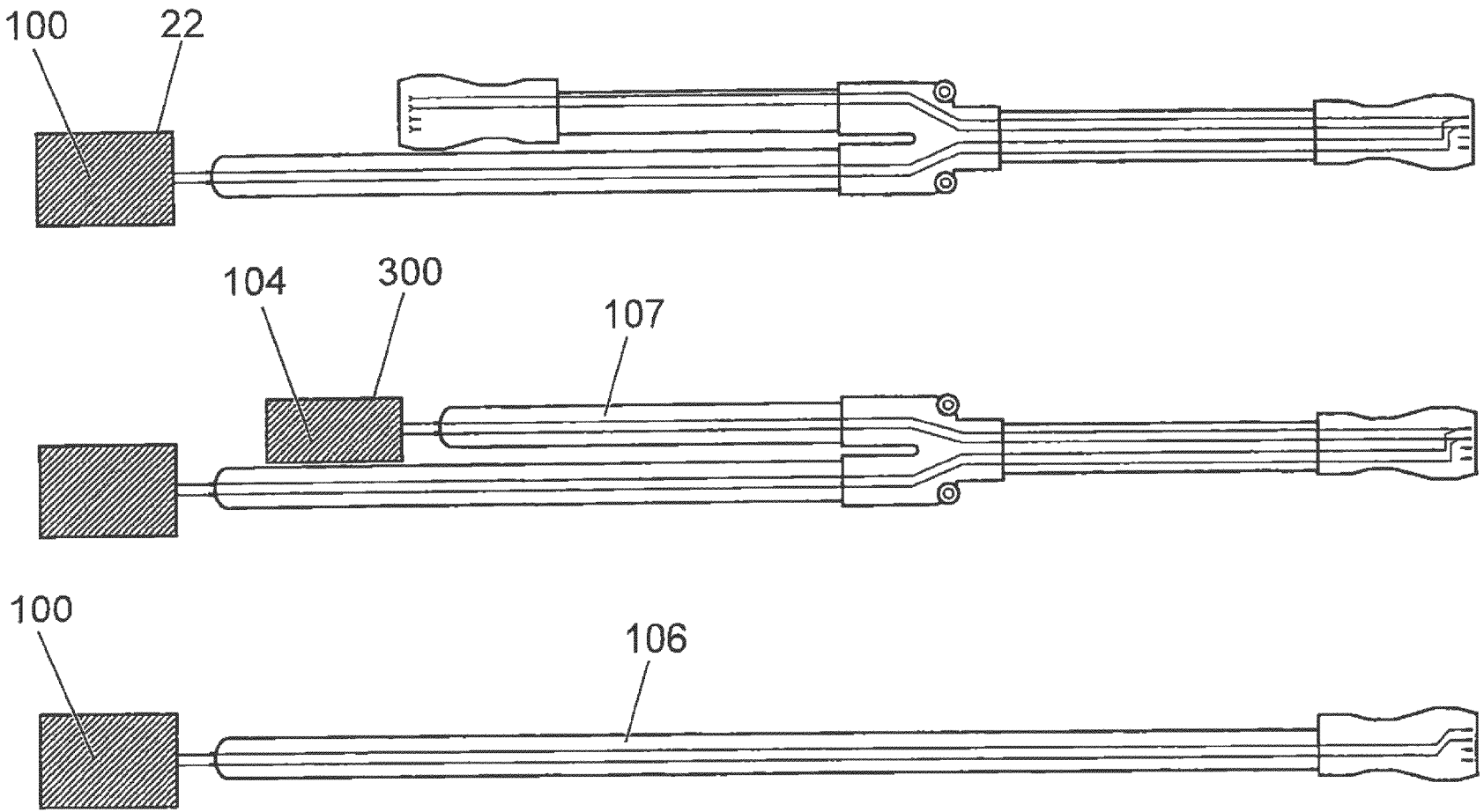
Figure 3:
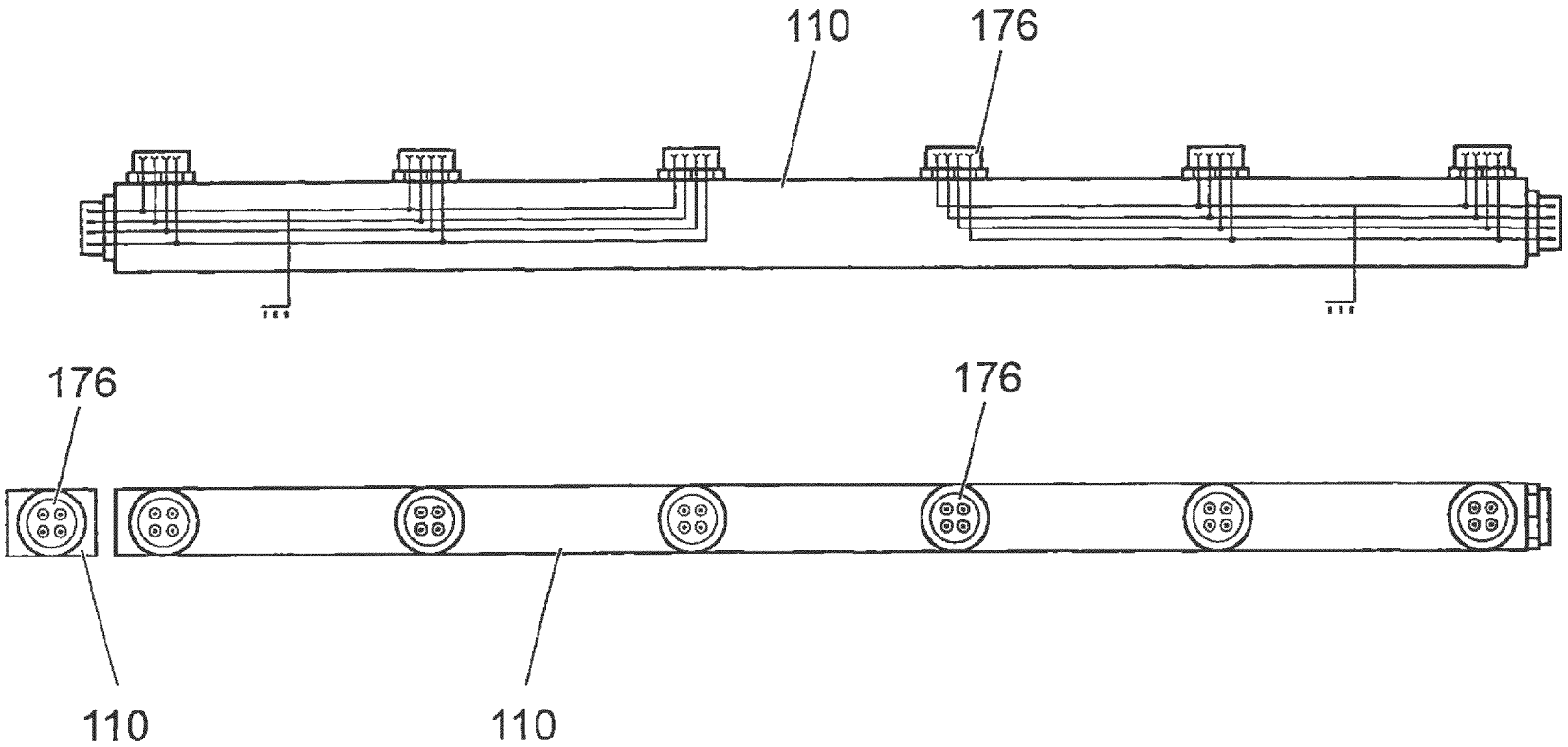
Figure 4:
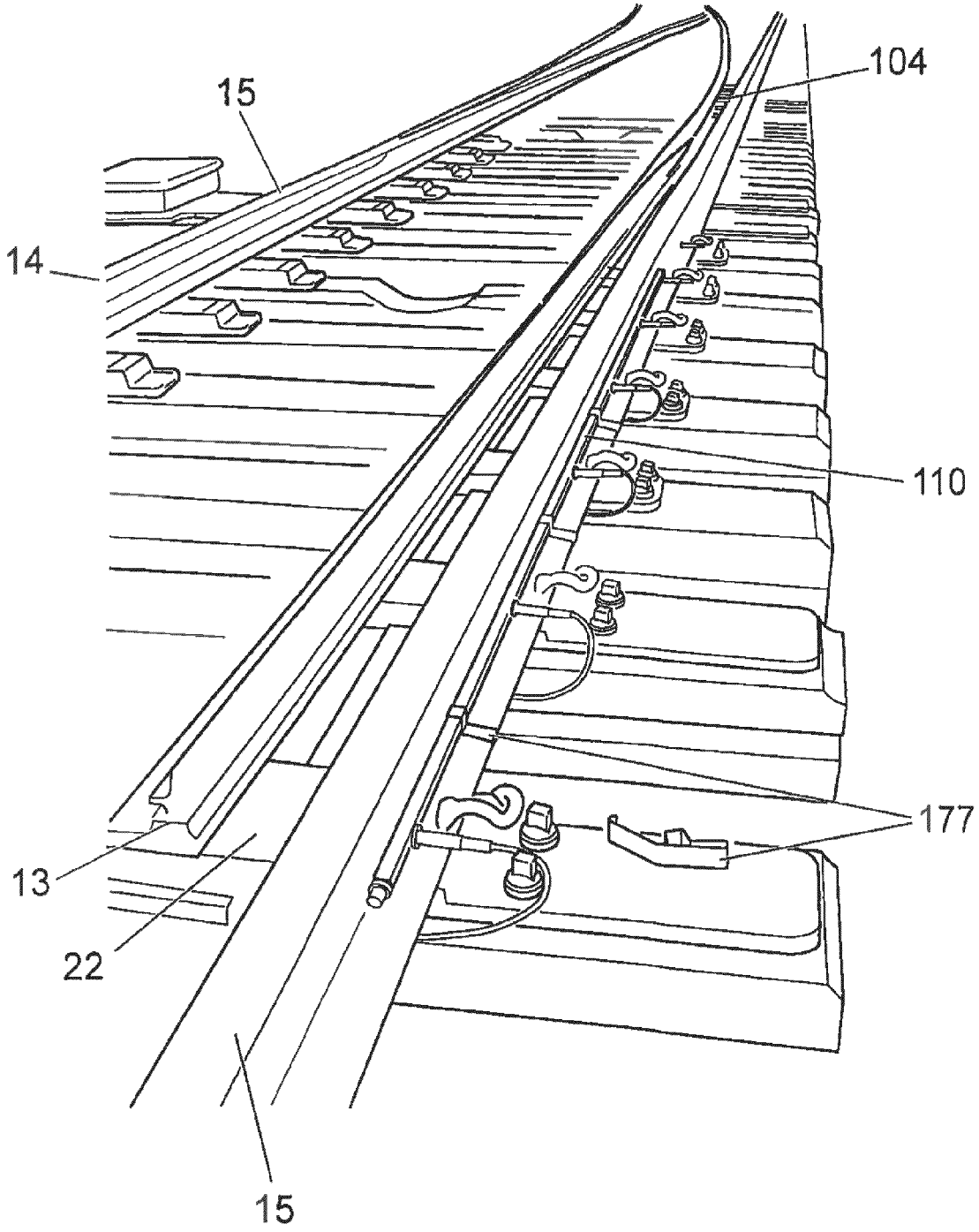
Figure 5:
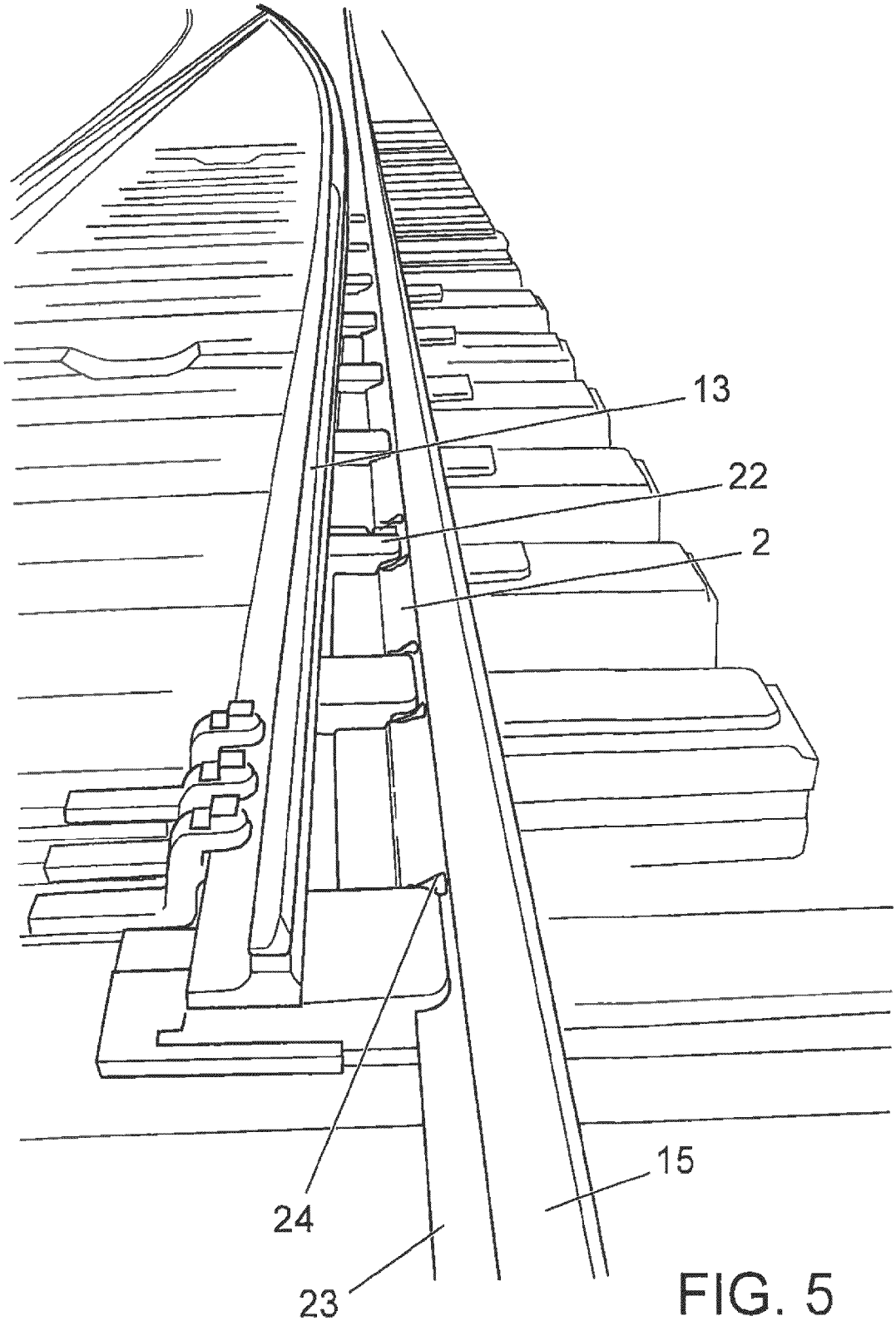
Figure 5A:
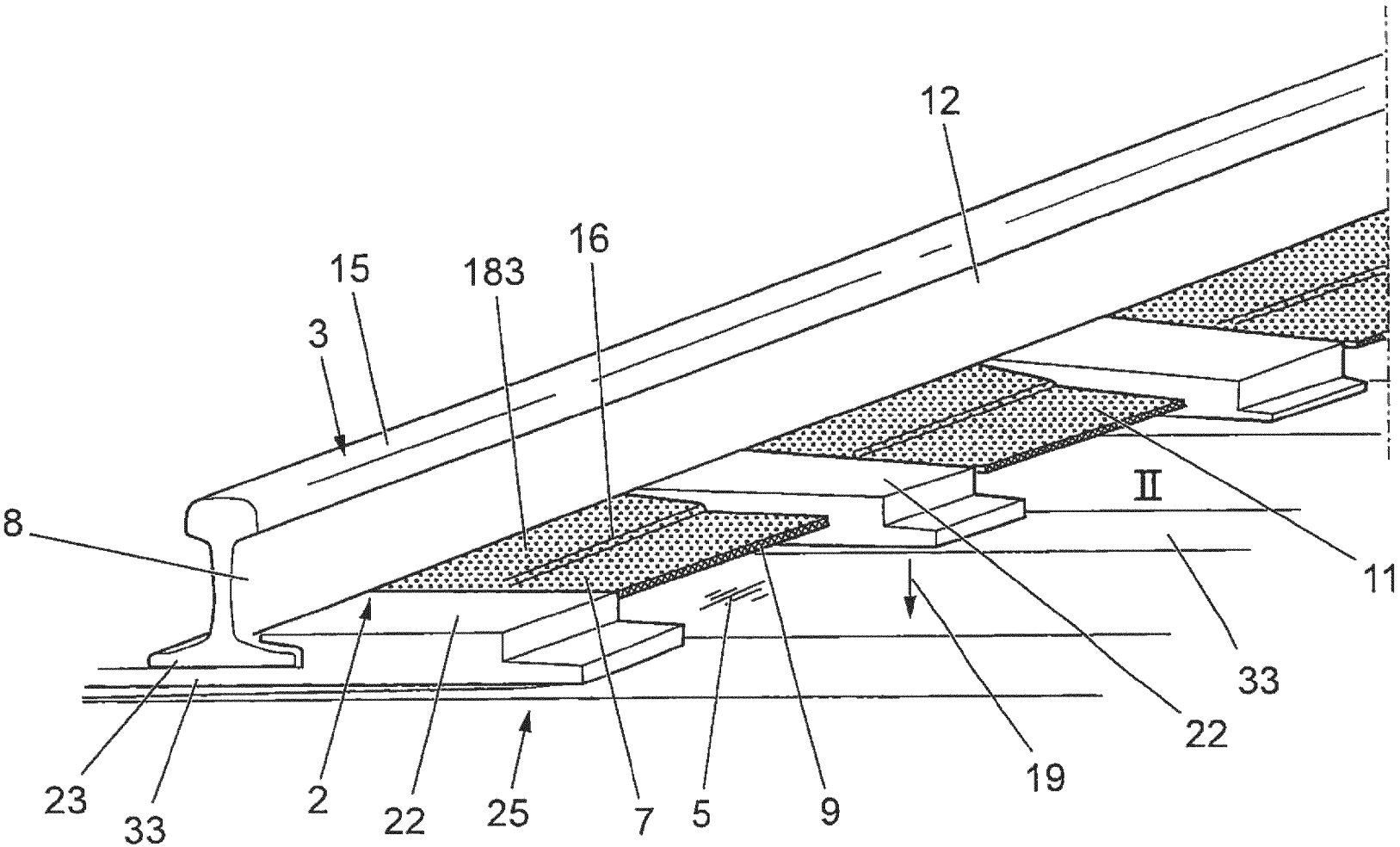
Figure 6:
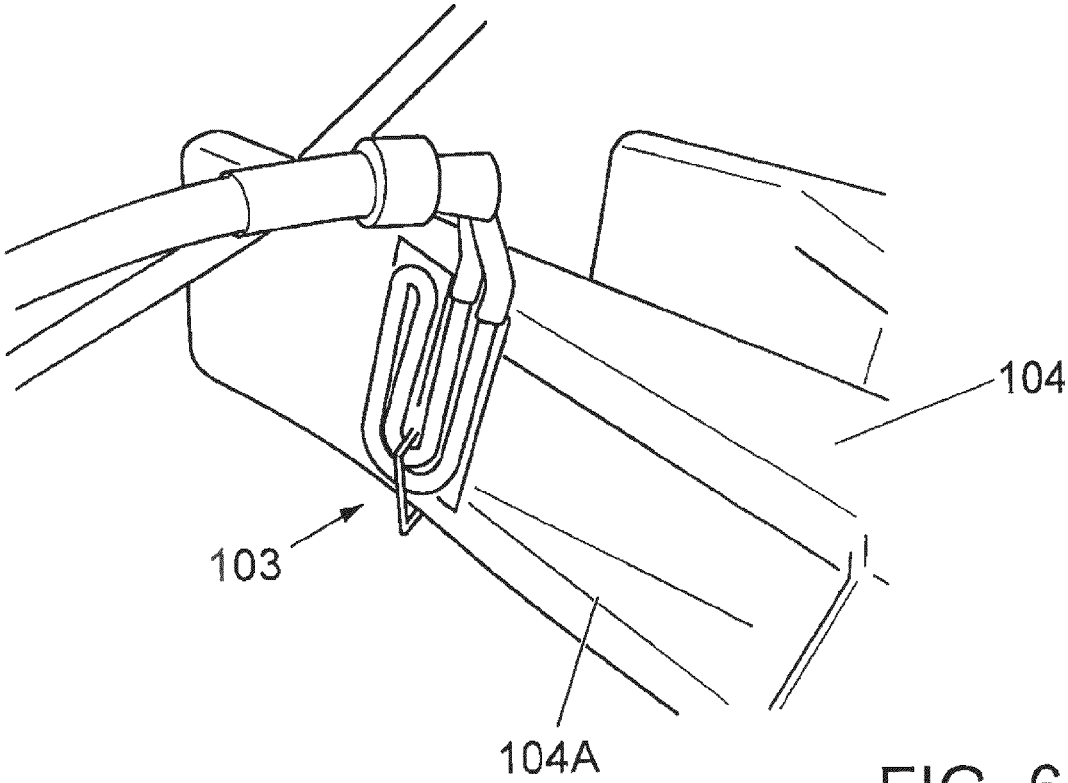
Figure 7:
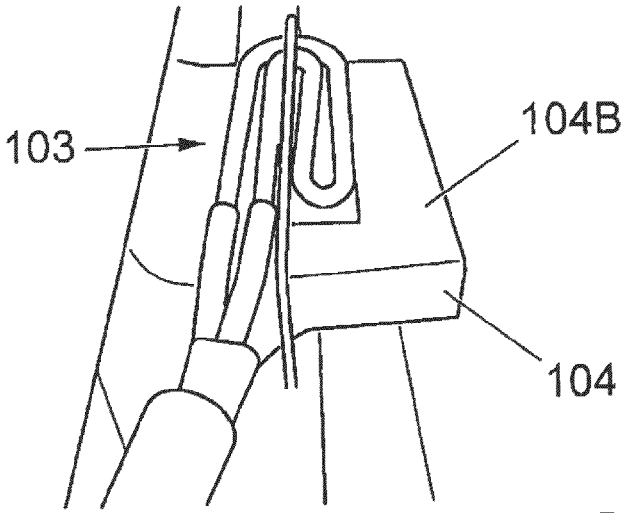
Figure 8:
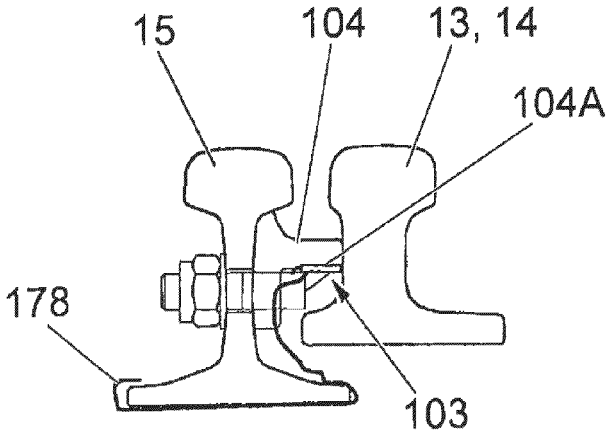
Figure 9:
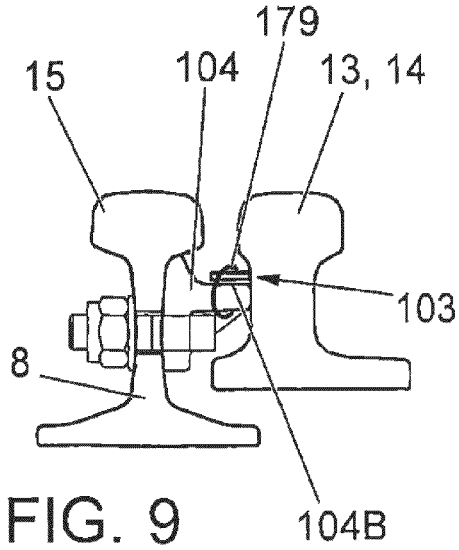
Figure 10:
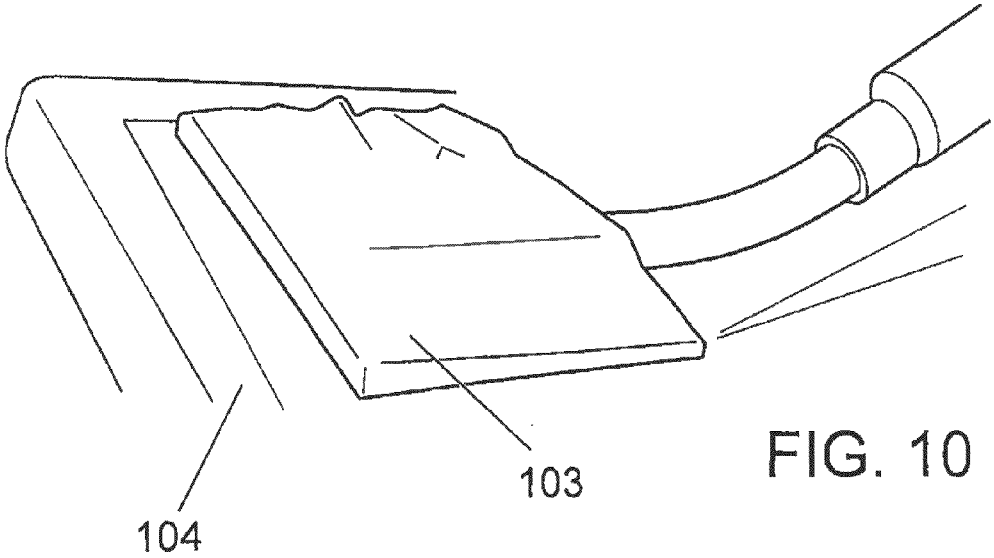
Figure 11:
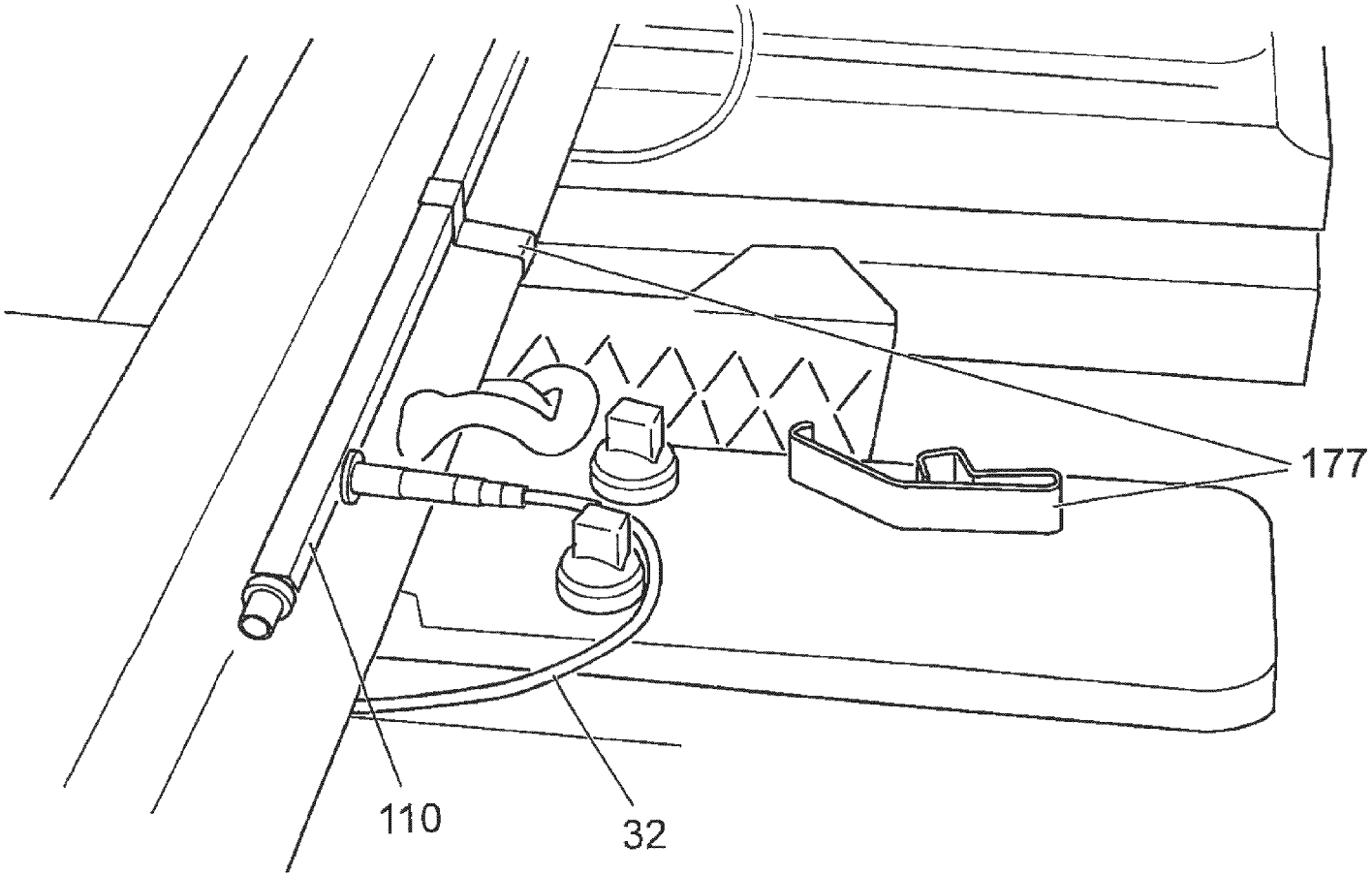
Figure 12:
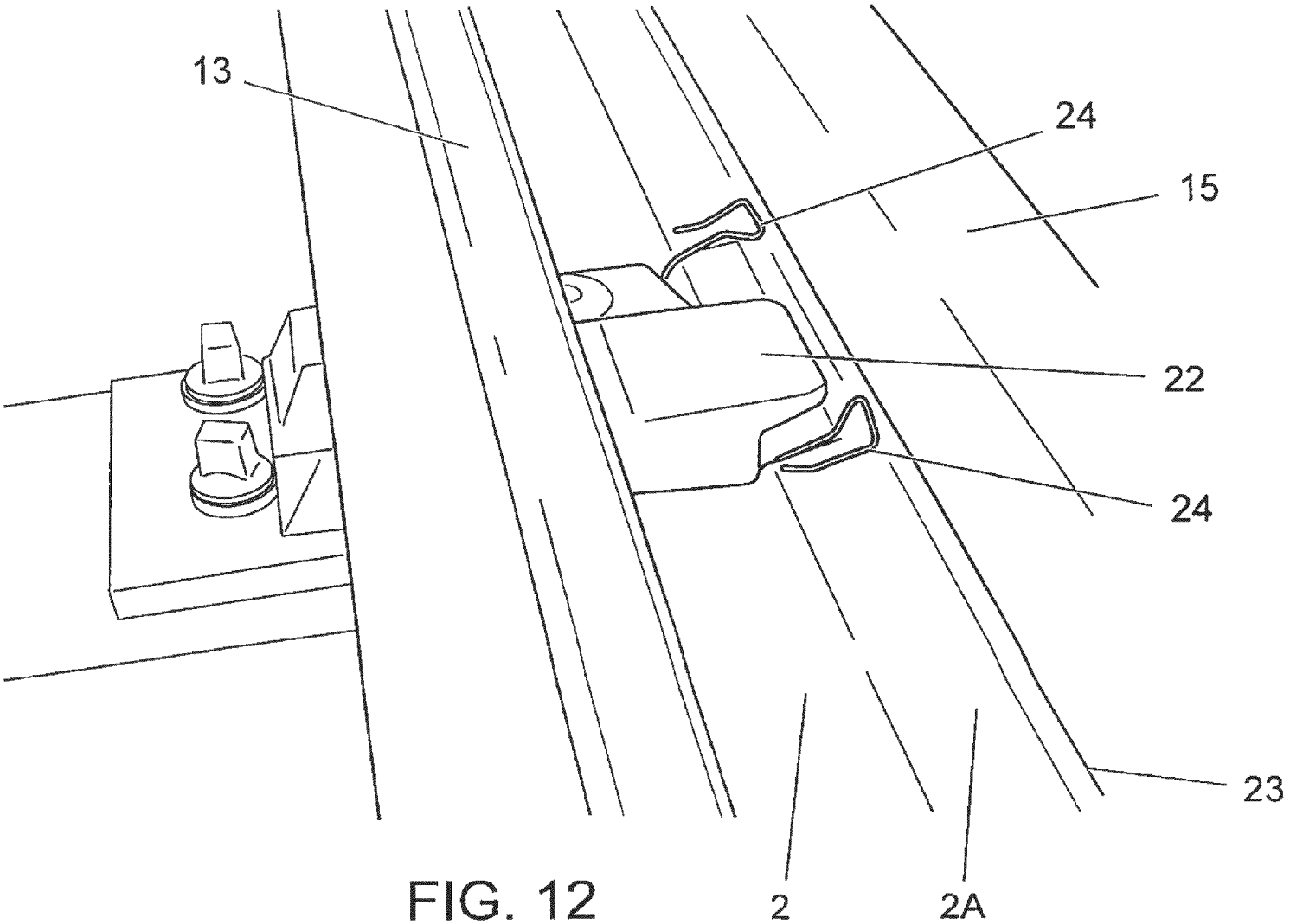
Figure 13:
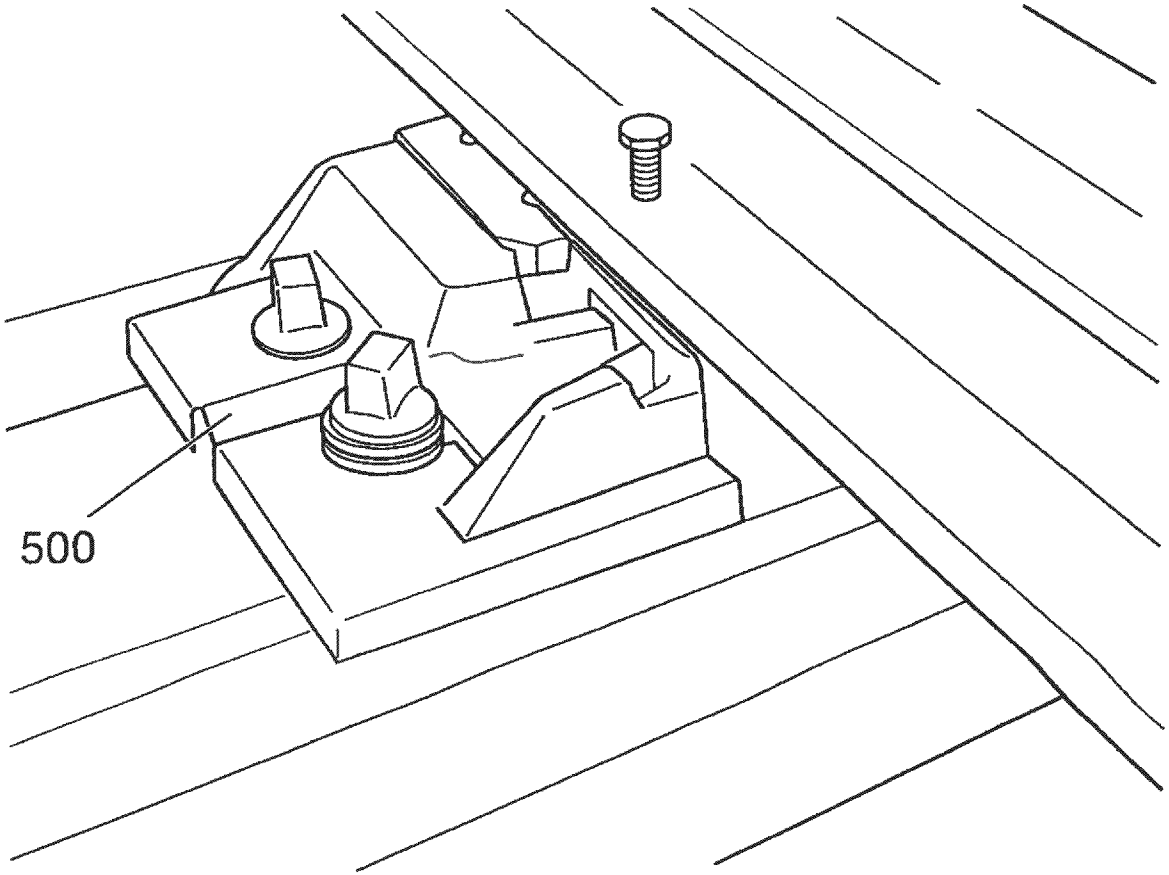
Figure 14:
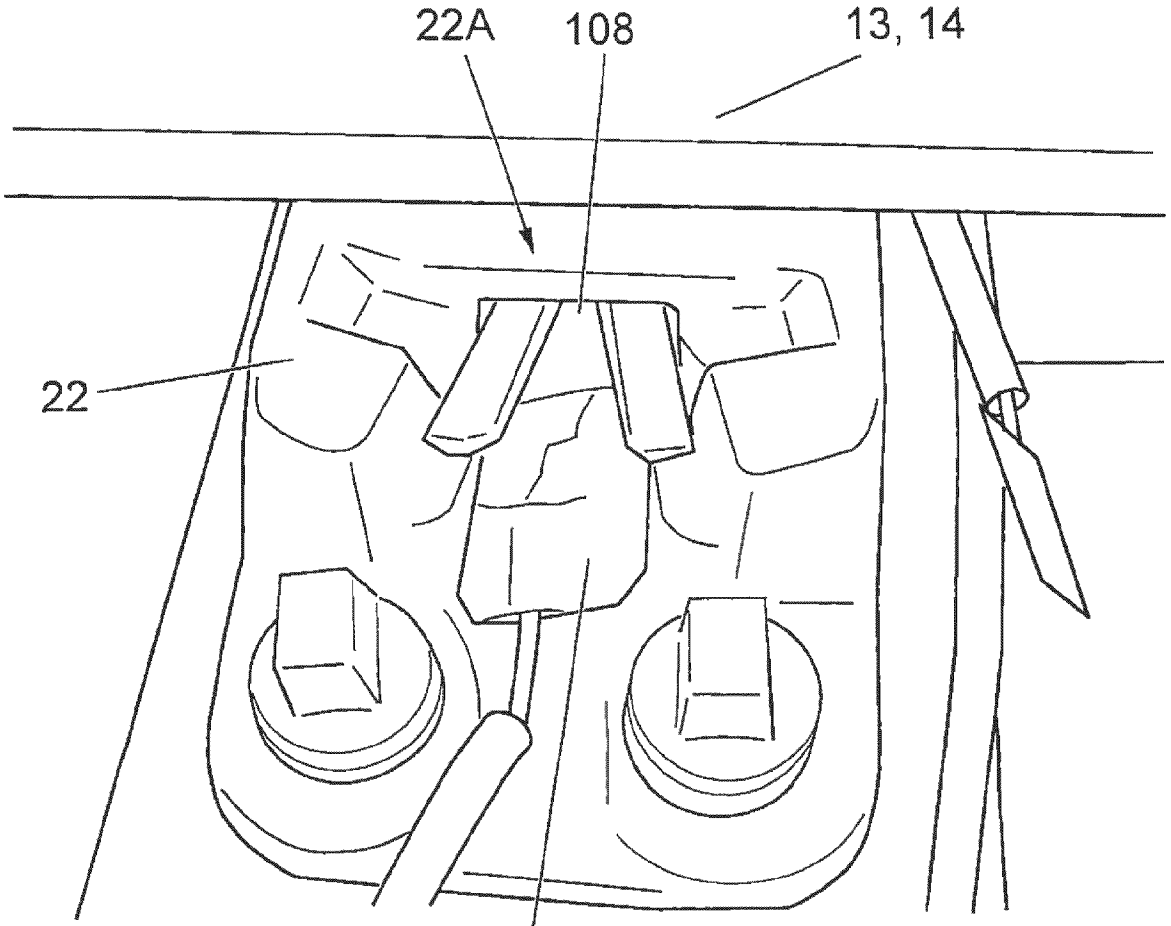
Figure 15:
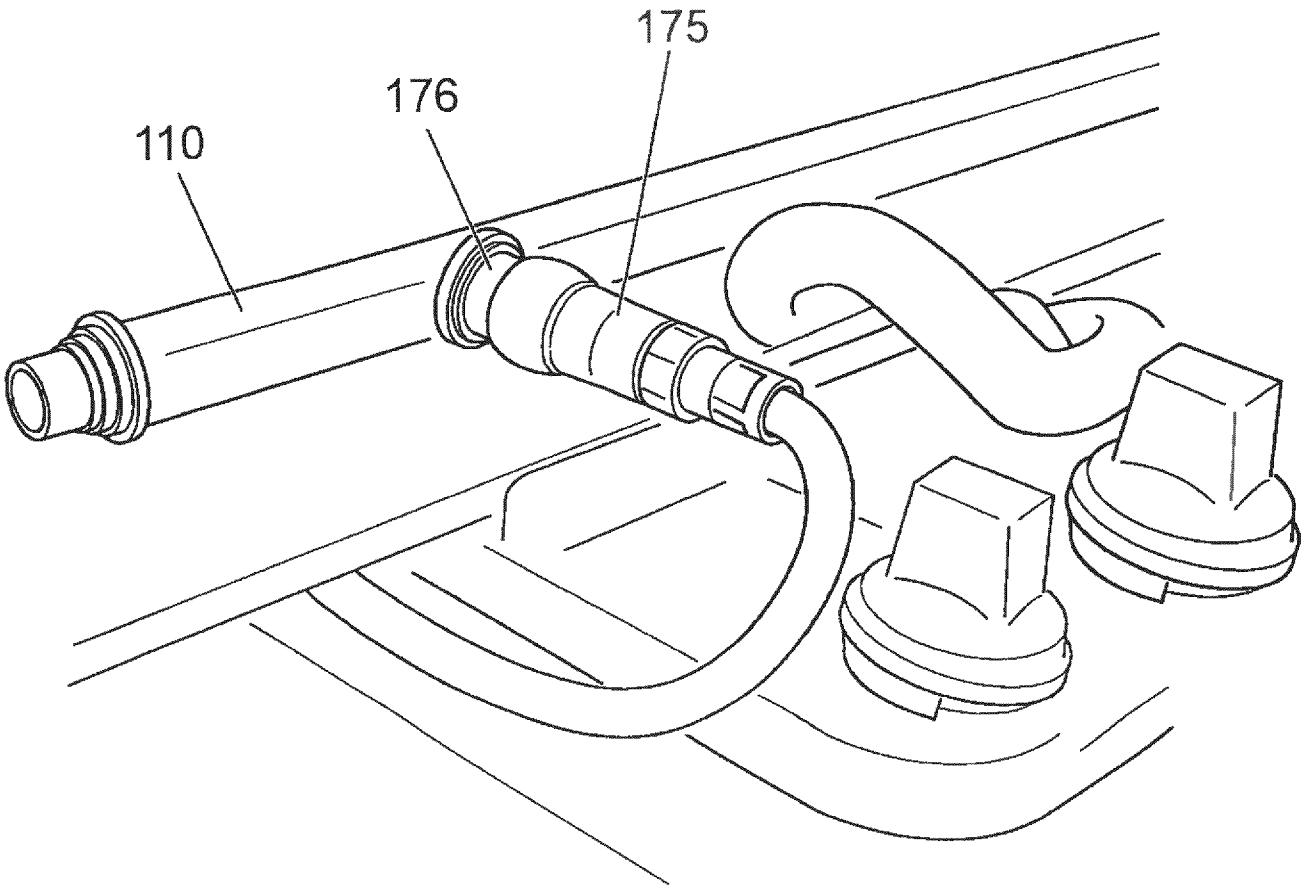
Figure 16:
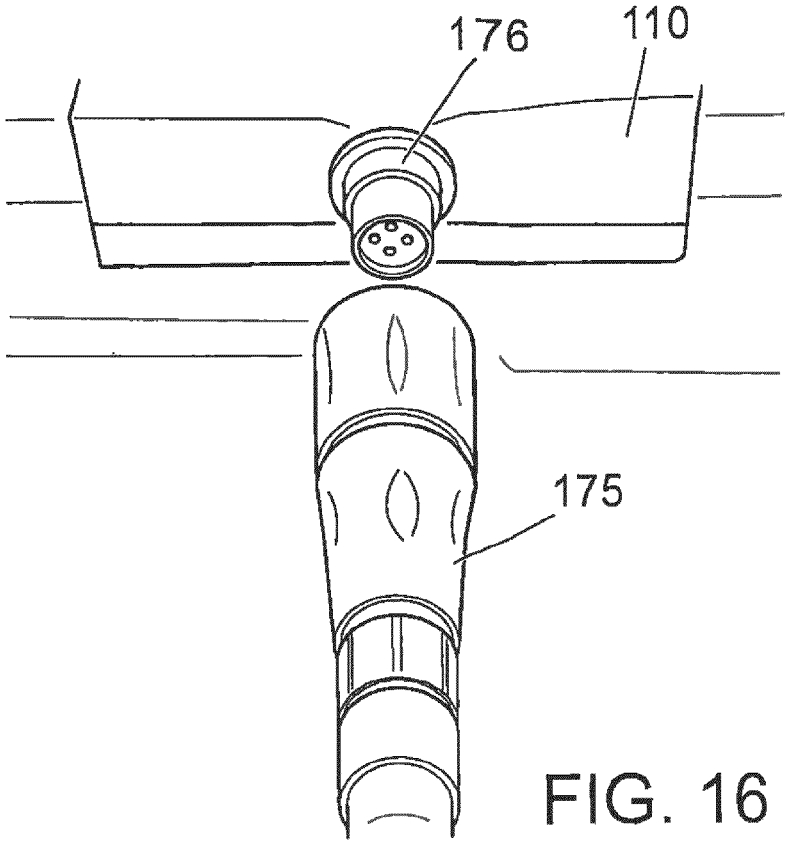
Figure 17:
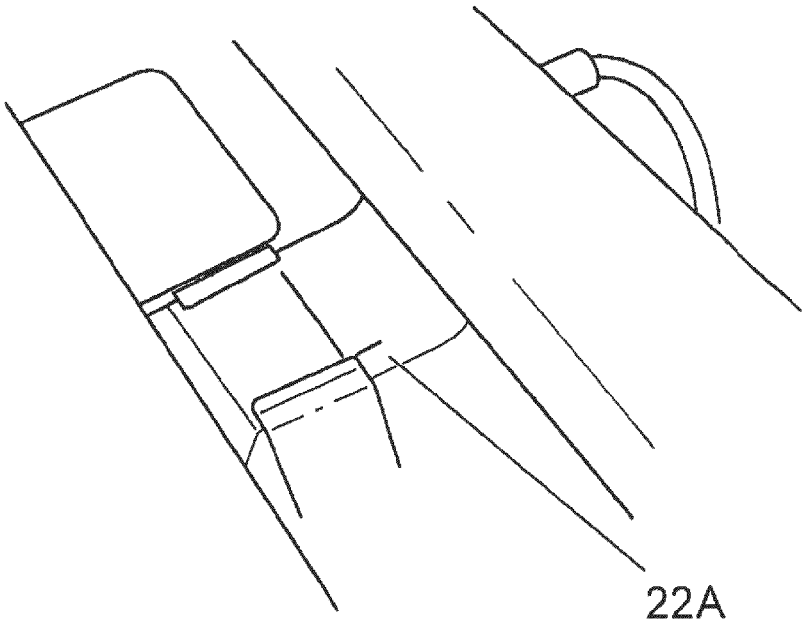
Figure 18:
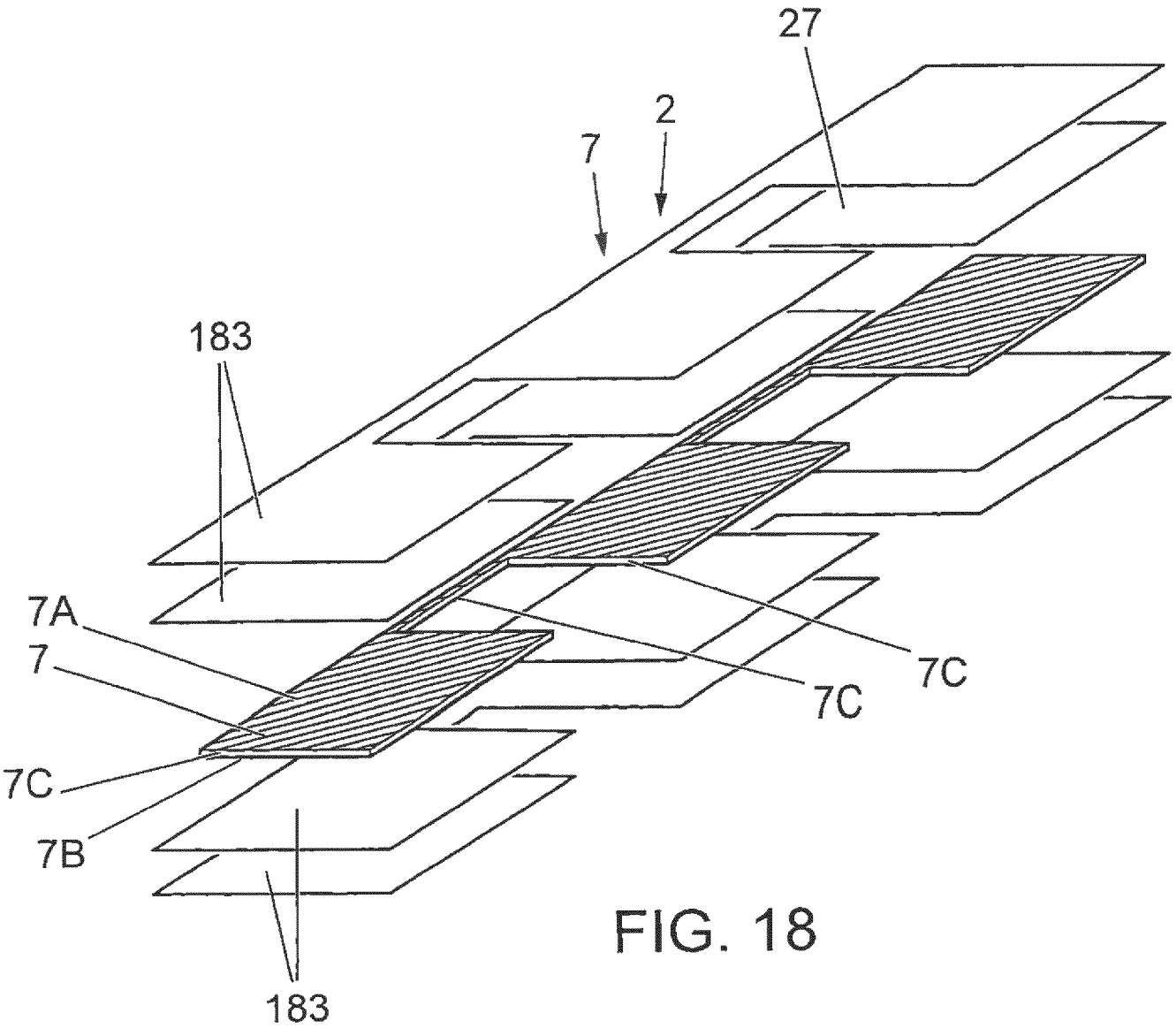
Figure 19:
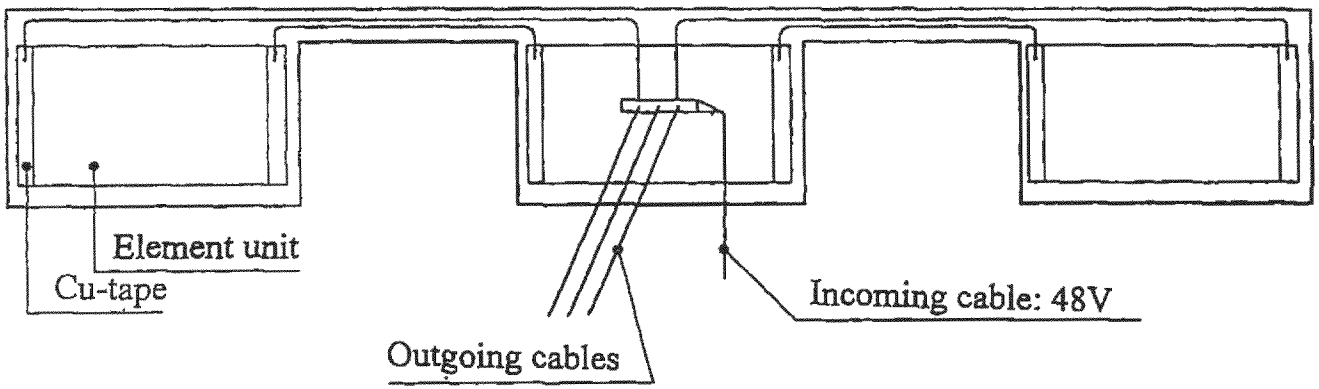
Figure 20:
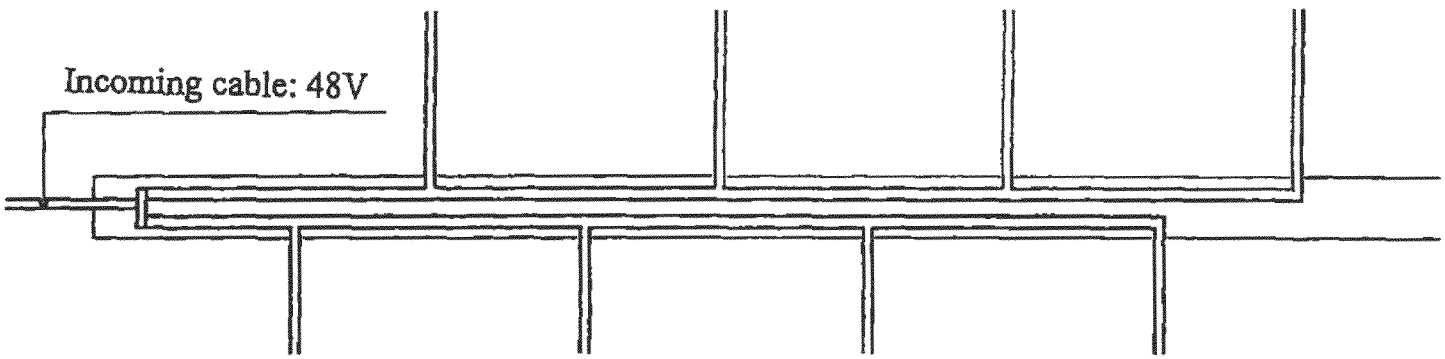
Figure 21:
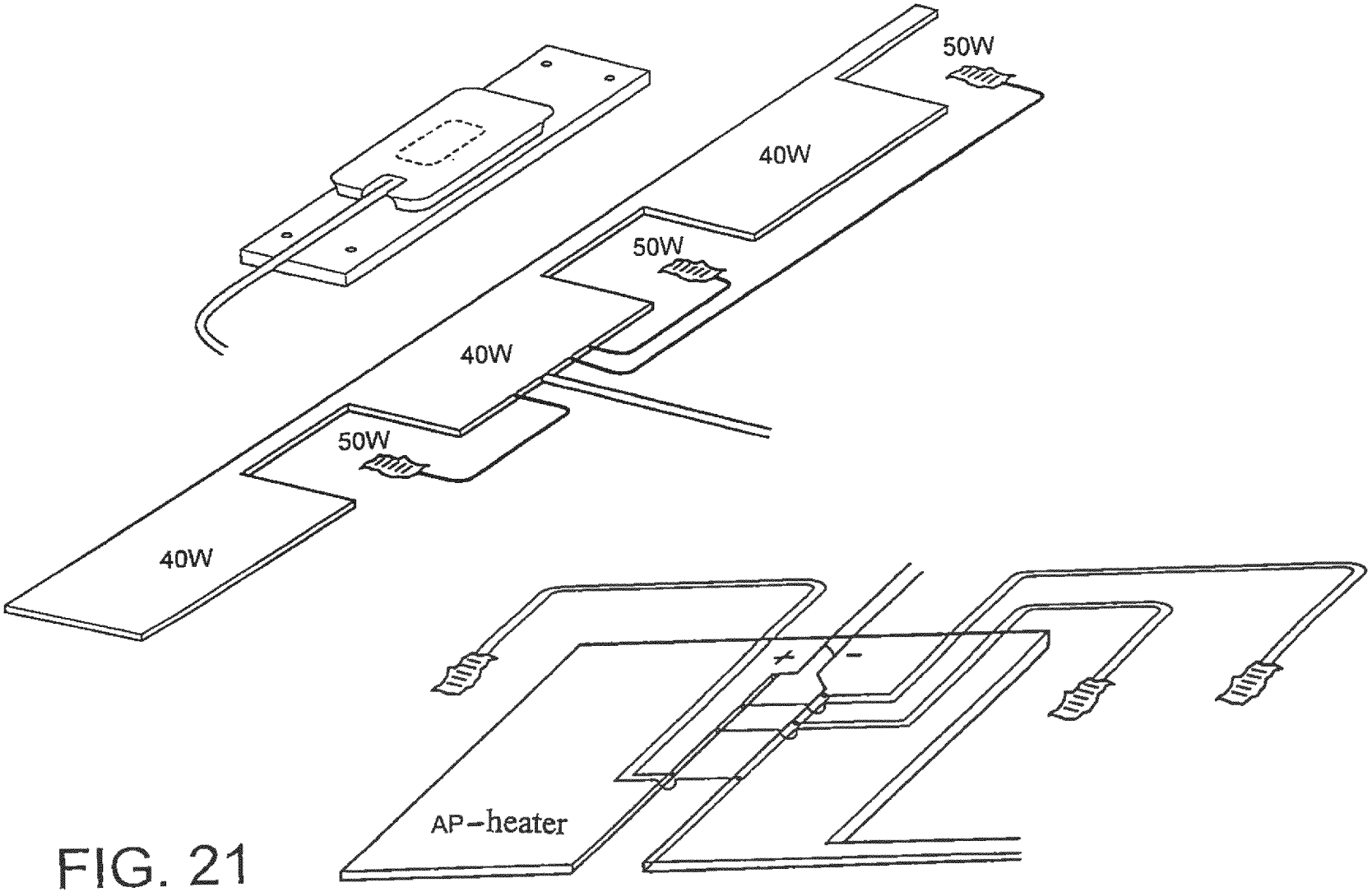
Figure 22:
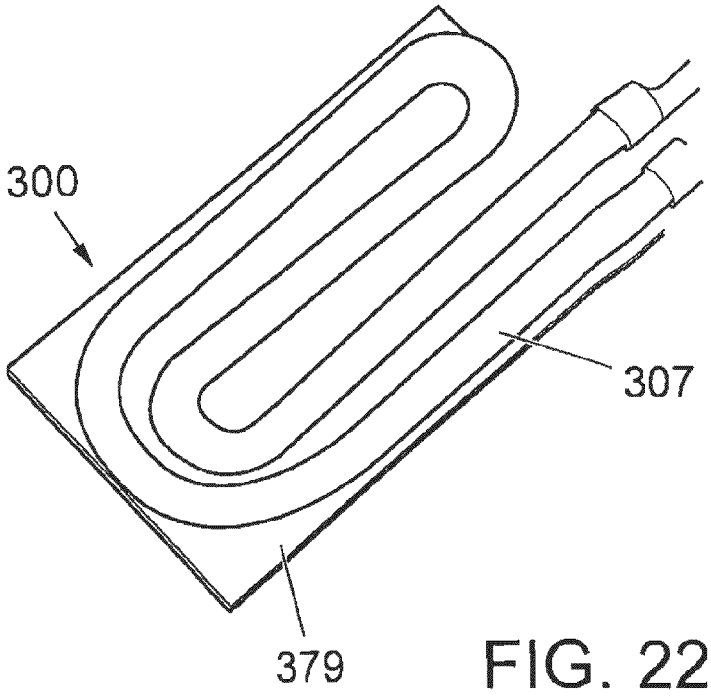
Figure 23:
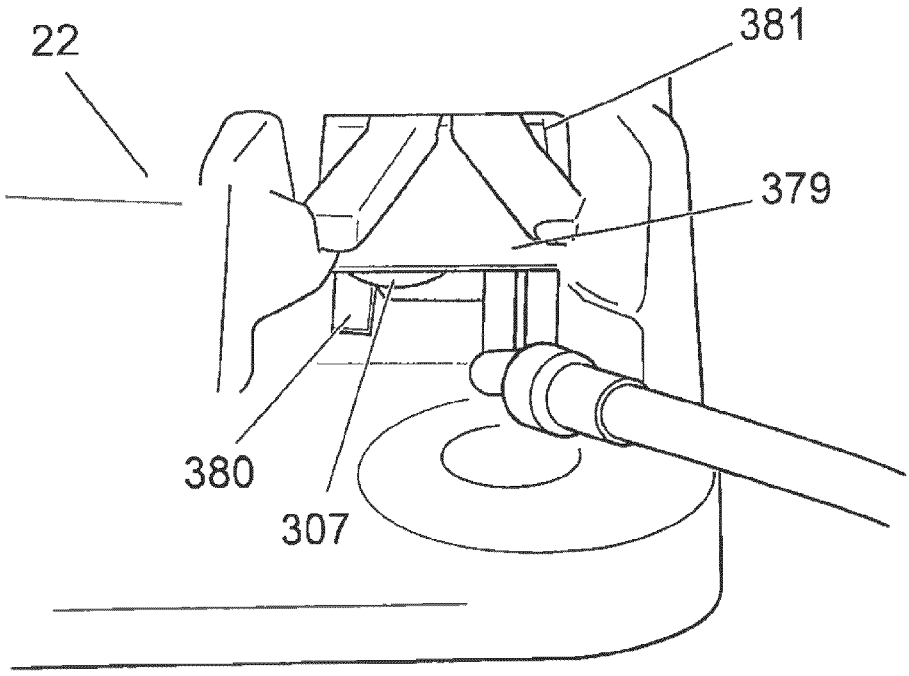
Figure 24:
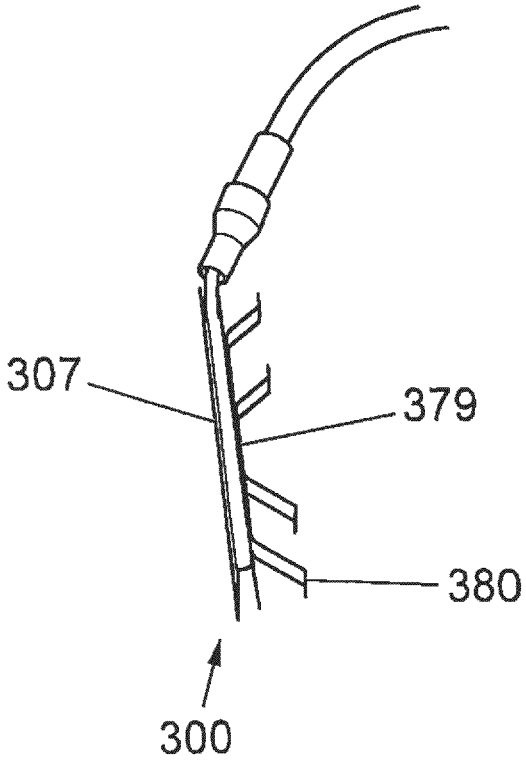
Figure 25:
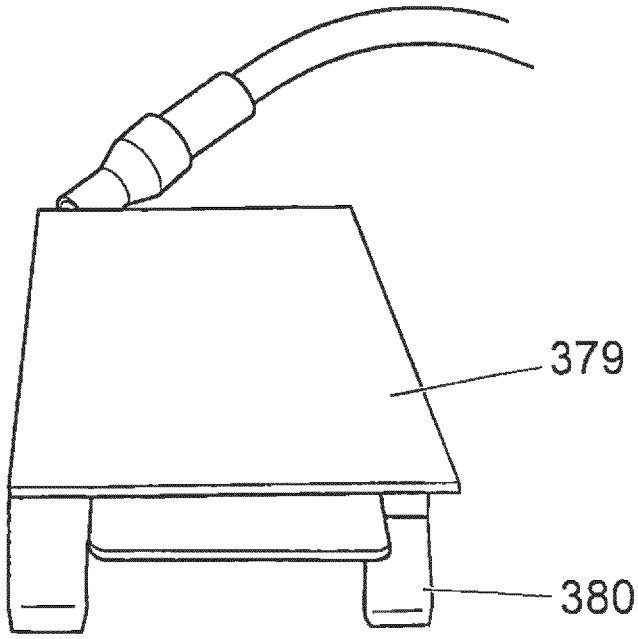
Figure 26:
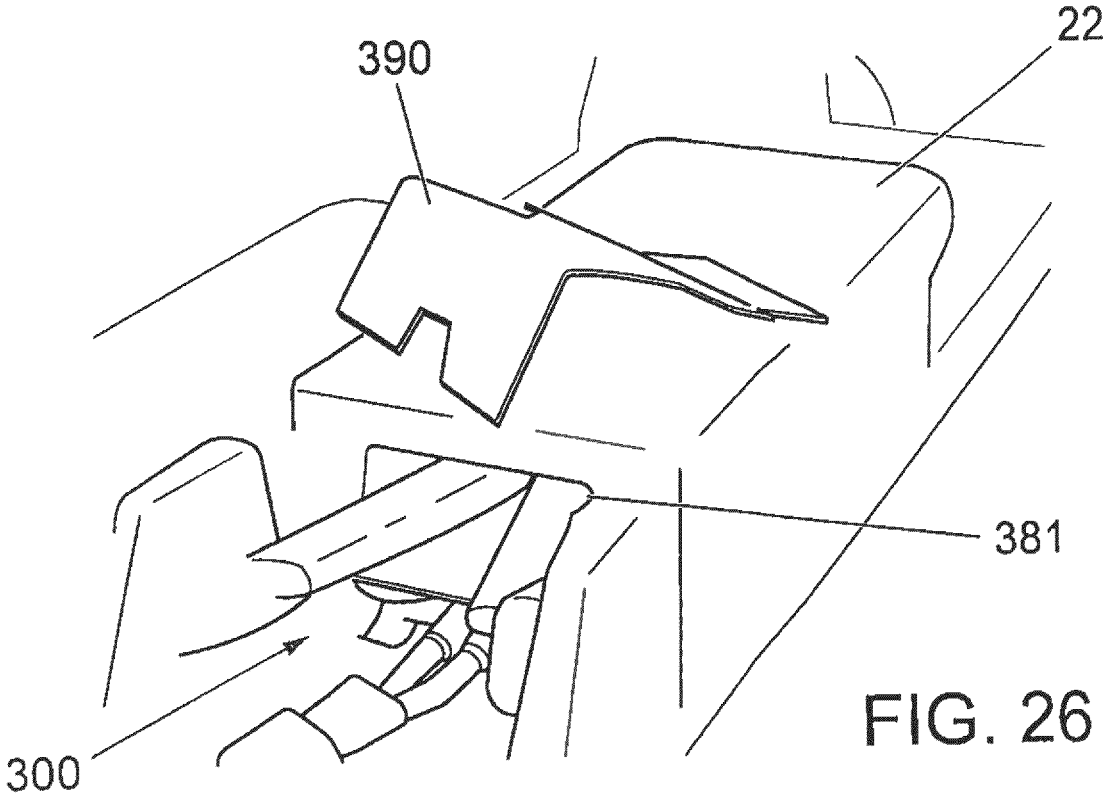
Figure 27:
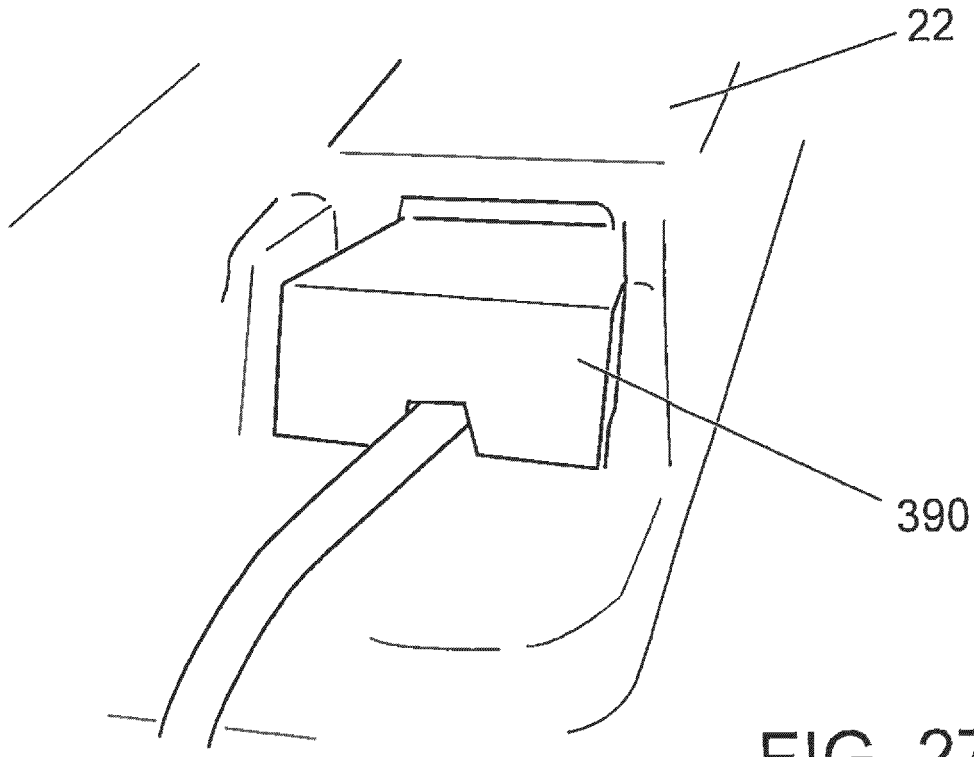
Figure 28:
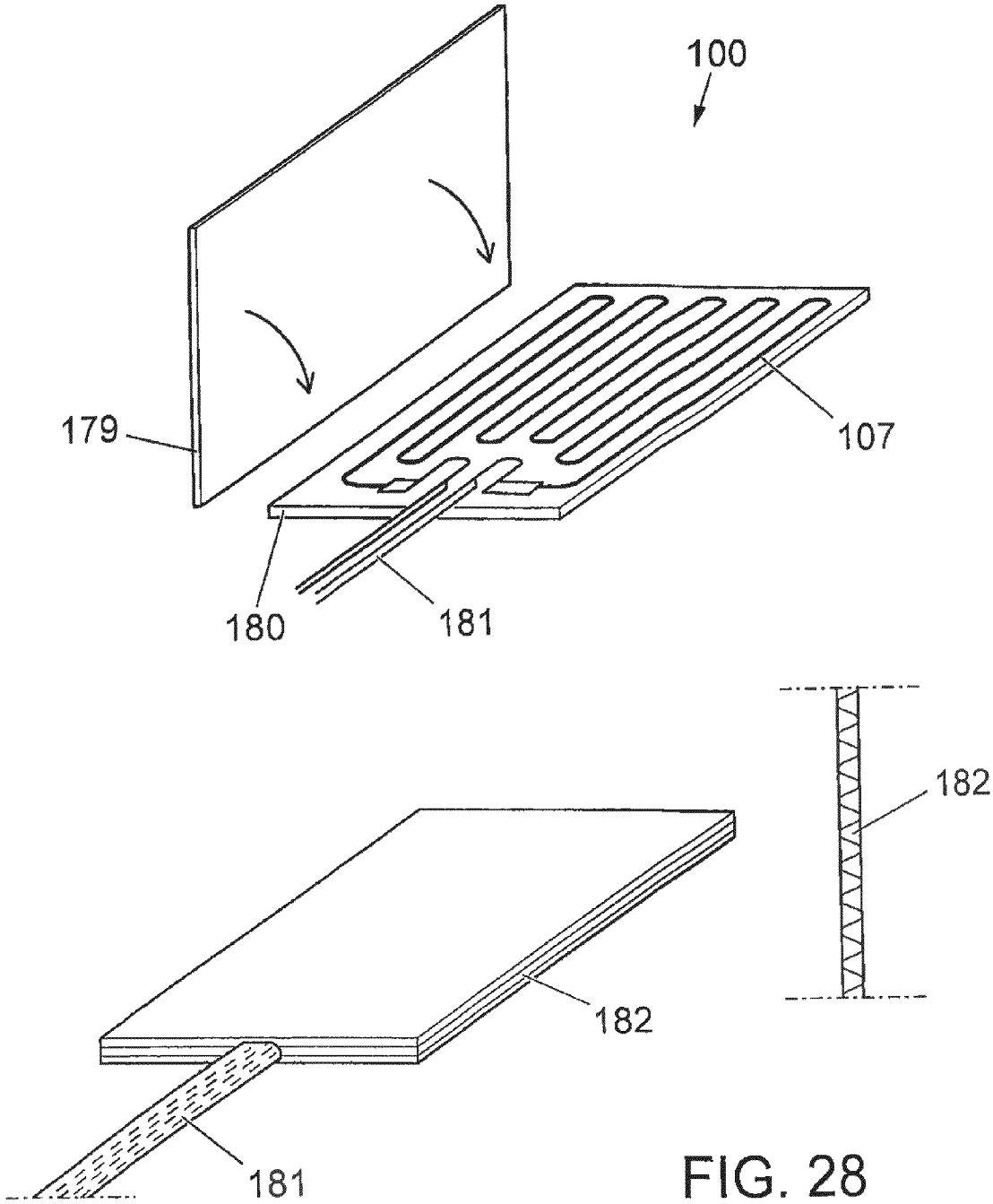
Figures 29, 30:
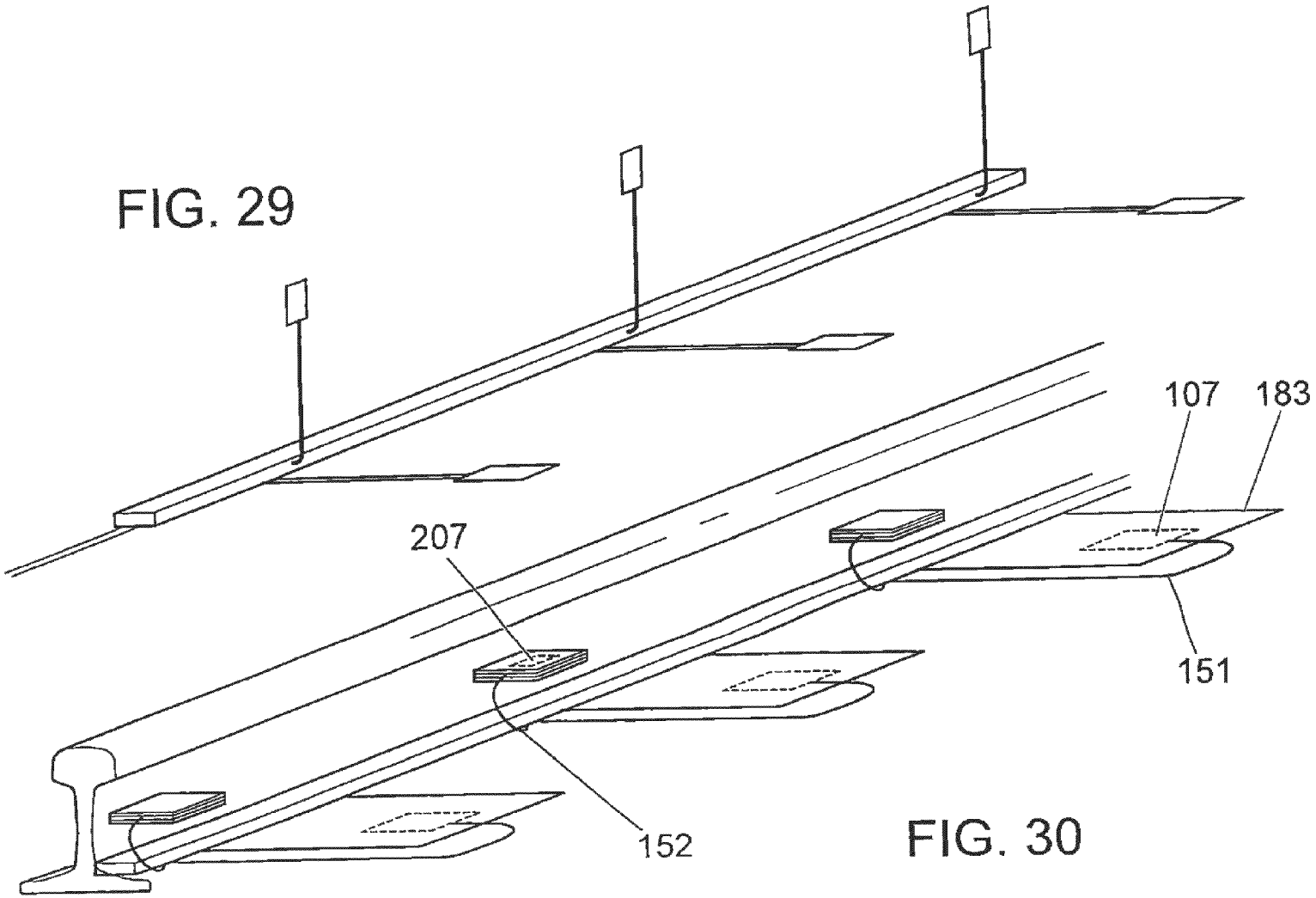
Figure 31:
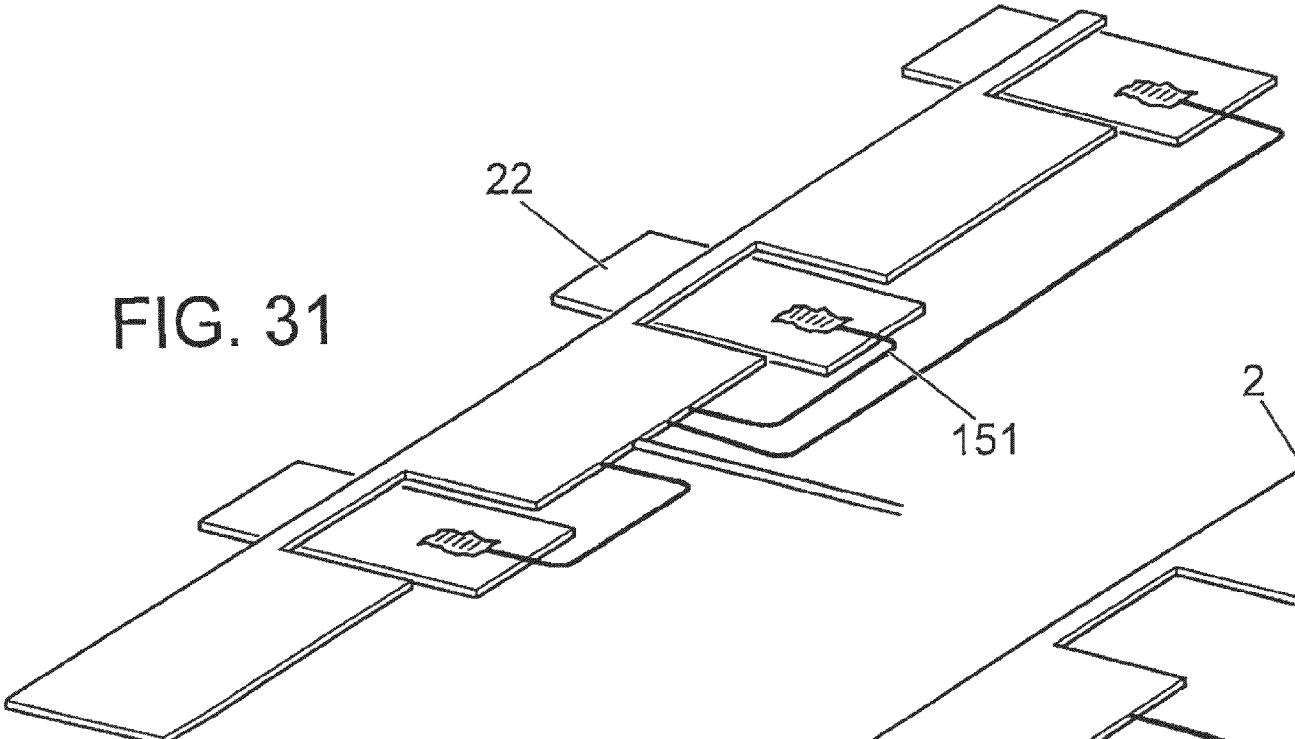
Figure 32:
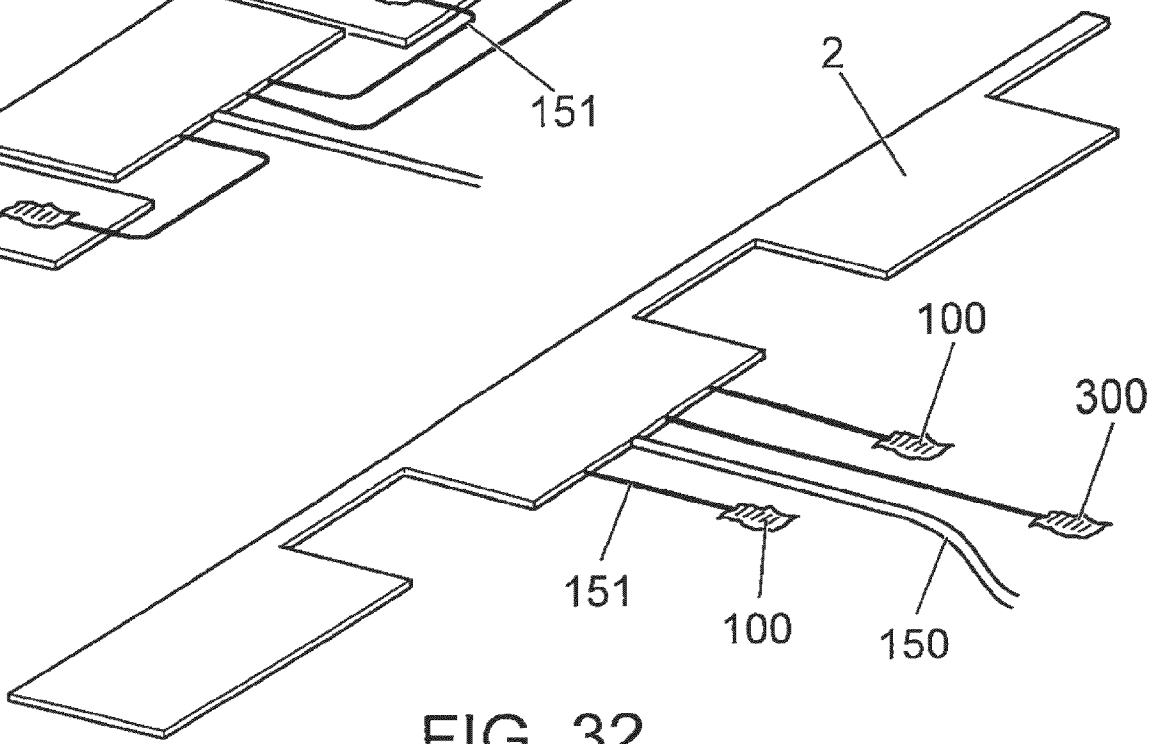

The invention is described below in the form of a number of preferred embodiment examples, reference being made to the accompanying drawings, in which, FIG. 1 shows a schematic switching view of a heating system according to the invention, FIG. 2 shows connections of different parts of a switch, FIG. 3 shows a current-supply bar from different directions, FIGS. 4-5A show in perspective a switch having the heating system, FIGS. 6-10 show a part of the heating system having heaters and fastening devices on a friction block and a supporting cleat of the switch, respectively, FIG. 11 shows a current-supply bar mounted along a track rail, FIGS. 12-14 show heaters on friction plates of a switch, FIGS. 15-16 show connections to a current-supply bar, FIG. 17 shows a heater on a friction plate, FIGS. 18-21 show exploded views and switching views, respectively, of heaters included in the heating system, FIGS. 22-27 show heaters for friction blocks, FIG. 28 shows an alternative of a heater for friction blocks, and FIGS. 29-32 show further examples of exploded views and switching views, respectively, of heaters included in the heating system.

The object of a heating system according to the present invention is, in addition to be able to engage desired heaters for the different parts being desired to heat as needs for this arise, also that the risk of snow and ice formation in a gap formed between the movable blade of a switch and the fixed track rail, and at other places in a switch exposed to snow and ice, should be prevented or at least decrease. This is possible thanks to the heater being thermally insulated in the downward direction with the purpose of directing the generated heat toward the surface of the heater. The invention has been tested secretly and the function of the same is very satisfactory as it works both in severe cold and in intense snowfalls, respectively. The area between the movable blade of a switch and the track rail of the switch in question, and other places where heaters are engaged, are, accordingly, kept free from snow and ice.

A device 1 in a heater 2 that is intended for railway tracks 3 and a switch 4 connected thereto, and that comprises an electrically operating panel-shaped heating part 7 layable on a support 5, has said heating part 7 arranged to be heat-insulated 9 against said support 5, thereby providing directed heating toward the free surface 11 of the heater 2, in order to thereby decrease snow and ice formation between the movable pivotably mounted blade 13, 14 of said switch 4 and the adjacent track rail 15 as well as other parts of the switch.

Said heater 2 is formed of an electrically operating heater element 16 embedded in a surrounding composite material 183 and having thermal insulation 9 connected thereto along the side 19 turned downward from the heating zone of the inwardly turned heating parts of said heater.

The heating part 7 layable against the ground 5 may form a common unit that, in doing so, is easy to put in place in a switch 4.

In that connection, the layable heating part 7 has recesses 21 fitting to straddlingly surround the friction blocks 22 that the switch blade 13, 14 in question is arranged to abut against in order to be able to provide displacement between different shunting positions in which it is arranged to connect close to the web 8 of the track rail and to be able to be spaced apart from the same, respectively. Accordingly, the heater 2 may be formed of a comb-like part that is arranged to be attachable to the track rail 15 by means of a plurality of fastening tongues 24 of metal receivable under the track rail 15 and the respective layable heating part 7 and resiliently clutching to the track railbase 23 and heating edge portion, respectively.

To the horizontal heating part 7, there is connected a sensor arranged to sense the external temperature of the heater 2 and, via a connected control system, supply the required power to the same in order to be able to provide the desired degree of melting of snow/ice, thereby being able to keep the switch free from snow and ice cover. The control system is preferably arranged to be remote-controlled and monitored via, for instance, the GSM network or any other internal network. Said control system is arranged to operate at reduced voltage, so-called extra-low voltage, preferably 48 V, a transformer being arranged to provide the conversion of the voltage.

The heater 2 is formed of a composite 183 of plastic, such as glass fibre and polyester, and having a carbon-based or another suitable resistive material 7 embedded therein so that heat generated inside the heater 2 is arranged to, insulatedly in the direction out from 19 the heater, provide directed heating in the direction inward toward 25 the inwardly turned free part formed of the heater.

The nature and the function of the heater is as follows: The heater 2 is manufactured in lengths 29, 30, 31 of approx. 2 m each and is manufactured in one piece with indentations for the friction blocks 22 that the blade 13, 14 runs on and are easy to mount on-site. The heater consists of a horizontal part 2 that lies under the blade and between the blade and track rail.

In order to prevent snow from being pulled along by the switch blades 13, 14 when the same slide against the blocks 22 that the blades 13, 14 move along upon shunting, heaters 100 are also arranged to be engaged for heating the plate-shaped friction blocks 22. In FIGS. 13-14, there are shown examples of heaters 100 for superposed friction plates 22A of the friction blocks 22 and how the heater 100 is received internally in an existing cavity 108.

In FIG. 11, there is also shown how the heater 2 is connected to an electric cable 32 running under the track rail 15 and in the gap between the sleepers 33 that the tracks 3 are attached to in a known way and connects to a supply bar 110 for current and that is included in a branch network 191 of electric connections 105, 106, 107 for different heaters 2, 100, 300.

Parts of the heater have a sensor that senses the surface temperature of the heater. When the surface temperature is less than the set value, a control system supplies the necessary power needed to keep the surface of the heater free from snow and ice cover. A control system may, depending on the configuration, handle a number of units. Said control system is arranged to operate at reduced extra-low voltage, preferably 48 V. A transformer is arranged to effect the conversion from mains voltage of, e.g., 230 V to said extra-low voltage of 48 V. The temperature-geographic zone decides which required power that is needed to keep the surface free from snow and ice cover. A guiding value for Western Sweden and Stockholm is that about 160-250 $W/m^2$ is required.

Heaters for the different parts of the switch generate a power that is sufficient for the same to be able to remove possible snow that lies on the track railbase 23, the friction blocks 22, also denominated friction plate, and supporting cleats 104. Neither needs the heater to be dismounted in connection with a switch needing to be redirected. The heater can also be adapted to the different occurring track-rail types that are used for railway, underground railway and tram traffic. Most common is rail of 50 kg, while rail of 60 kg is used where high-speed trains or where heavy railway traffic runs.

FIGS. 6-9 show examples of heaters 300 for supporting cleats 104 situated at the switch, distributed along the length extension thereof. Heaters 103 for the same can be situated at a selectable location, e.g. on the underside 104A or upperside 104B of the supporting cleats 104. The function of said supporting cleats 104 is to limit the laterally displacement of the switch blades 13, 14 toward adjacent rails 15.

According to the invention, in a heating system 190 for a switch 4 of a trackway 3, there are electrically operating heaters 2, 100, 300 applicable to the switch 4 and selectably easily connectable to a branch network 191 that extends along said switch 4. The branch network 191 is formed of a plurality of electric connections 105, 106, 107 arranged for the connection to a desired number of heaters 2 in the form of heating plates 7 for heating the track railbase 23, heaters 100 for the friction blocks 22 that the switch blades 13, 14 move along upon shunting motion, as well as heaters 103 for the supporting cleats 104 that limit the lateral turning motion of said switch blades. Said electric connections 105, 106, 107 are connected to a supply bar 110 in question for current and that is arranged to extend along the length L of the switch.

Groups I; II; III of heaters 2, 100, 103; 2, 100, 300; 100, 300 for the respective sides of the switch are, in that connection, connected to a common control cubicle 111 situated beside the switch 4. An individual current-supply bar 110 for the respective group I; II; III is fixed to said track and is connected individually to said control cubicle 111.

The heater 2; 100, 103; 300 may be formed of an electrically operating heater element 7; 107, embedded in a surrounding composite material 183, and having thermal insulation connected thereto along the side turned downward from the heating zone of the inwardly turned heating parts of said heater or from both sides 7A, 7B thereof and having sealing material along the edges 7C thereof and having shape-adapted openings 21 for the friction plates.

Namely, the layable heater 2 has such recesses 21 that the same fit to straddlingly surround the friction blocks 22 that the switch blade 13, 14 in question is arranged to abut against to provide displacement between different shunting positions, in which it is arranged to connect close to the web 8 of the track rail and to be spaced apart from the same, respectively.

Accordingly, the heater 2 is formed of, for instance, a comb-like plate 7 arranged to be attached to the track rail 15 by means of clutching fastening clamps 24 that by clutching parts clamp the heating part 2 and the edge portions 2A thereof to the track railbase 23. See for instance FIG. 12.

To the horizontal heating part 7, there is connected a sensor arranged to sense the surface temperature of the heater 2 and, via a connected control system (not shown), supply the required power to the same in order to be able to provide the desired degree of melting of snow/ice, thereby keeping the switch 4 free from snow and ice cover, as well as that the control system preferably is remote-controlled and monitored via, for instance, the GSM network or another internal network. The control system may, such as has been indicated above, be arranged to operate at extra-low voltage, preferably 48 V, reduced from the element voltage of the heater 2 as well as other heaters, and that a transformer is arranged to provide conversion of said voltage. The control system has the purpose of supplying sufficient power to the different parts of the switch-heating system.

Friction-plate heaters 300 are formed by attaching a tubular element 307 to a metal plate 379 having resilient legs 380. The purpose of the tubular element, as being supported by the metal plate 379, is to supply heat to the iron material of the friction plate. In order to provide the heating of said friction plate, it is important to obtain immediate contact between the tubular heater 307 and the iron material of the friction plate. This is provided by allowing the resilient legs of the tubular element to press up the tubular heater 307 against the material of the friction plate in the void 381 formed in the interior of the friction plate 22. Therefore, said tubular heater 307 is arranged to face and abut the iron material of the friction plate, even if it in the drawings has been shown to be turned in the downward direction from the same. Another application may also be a possibility.

Friction-plate heaters 100 may alternatively be formed of steel or aluminium plates 179, 180 put together in pairs and having a sandwiched heating wire 107 connected to an electric cable 181 as well as having a seal 182 along the edges of the heater 100. An example thereof is shown in FIG. 28, but friction-plate heaters 300 according to the above is preferred as they provide higher power and heat in a better way.

Supporting cleat heaters 103 are formed of an electric heating plate fixed on the upperside 103B or on the underside 103A of the respective supporting cleat 104. Suitably, the heater 103 is fixed by a clutching clamp 178, 179.

The supply bar 110 is formed of a section that is clampable to the track rail 15 and having an enclosed electric wire. A suitable clamp 177 for the fastening thereof to the track rail is shown in FIG. 11. A said clamp 177 may also be arranged to fix the wiring.

Connections 175 between the supply bar 110 and the heaters are formed of connectors, for instance male and female connectors shown in the illustration of FIG. 16, and that easily are interconnected with a mating coupling part 176 on the supply bar 110 and with the control cubicle 111, respectively.

In FIG. 13, there is shown a sheet-metal plate 500 that fixes the wiring and the heater and efficiently protects the same.

The function and nature of the invention should have been understood from what has been described above and shown in the drawings.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A heating system for a switch of a trackway, comprising:

a plurality of electrically operated heater elements selectively connectable to a branch network of electric connections extending along the switch;

wherein the heater elements include heating plates for a track railbase, friction-plate heaters, and supporting cleat heaters; the electric connections connect a desired number of heater elements to at least one respective current supply bar extending along a length of the switch; the heating plates are arranged to provide heat directly to surfaces of the heating plates in order to decrease snow and ice formation between a blade of the switch and an adjacent track rail; at least one heating plate includes a horizontal comb-like plate arranged to be attached to the track rail by a plurality of fastening tongues configured to be received under the track rail and to clutch the track railbase and an edge portion of the heating plate; and a friction-plate heater is formed by a tubular element heater fitted to a metal plate on resilient legs.

2. The heating system of claim 1, wherein groups of heater elements for respective sides of the switch are connected to a common control cubicle.

3. The heating system of claim 1, wherein a heating plate is embedded in a surrounding composite material and has thermal insulation connected thereto along a side turned downward from a heating zone of inwardly turned heating parts of the heating plate.

4. The heating system of claim 1, wherein heating elements are formed of a plastic composite having a resistive material embedded therein so that heat generated inside the heating elements is arranged to provide, insulatedly in a direction outward from the heating elements, directed heating inward toward inwardly turned parts of the heating elements.

5. The heating system of claim 1, wherein the tubular element heater has a plastic end-wall cover.

6. The heating system of claim 1, wherein a supporting cleat heater is formed of a heating plate fixed on an upperside or an underside of the respective supporting cleat.

7. The heating system of claim 1, wherein a current supply bar has a section configured to be clamped to the track rail and has an enclosed electric wire.

8. The heating system of claim 1, wherein connections between a supply bar and the heater elements are formed of connectors.

9. The heating system of claim 2, wherein current supply bars for respective sides of the switch are connected individually to the control cubicle.

10. The heating system of claim 3, wherein the heating plate is layable and has recesses configured to straddlingly surround friction blocks that the switch blade is arranged to abut against for displacement between different shunting positions.

11. The heating system of claim 3, wherein a sensor is connected to the horizontal plate that is arranged to sense a surface temperature of the heating plate and, via a connected control system, to supply power to the heating plate for a desired degree of melting of snow and ice, thereby keeping the switch free from snow and ice.

12. The heating system of claim 11, wherein the control system is configured for remote monitoring and control.

13. The heating system according to claim 11, wherein the control system is arranged to operate at a voltage reduced from a voltage applied to the heating plate by a transformer.

* * * * *